US011014221B2

(12) United States Patent
Koppenhoefer et al.

(10) Patent No.: US 11,014,221 B2
(45) Date of Patent: May 25, 2021

(54) APPARATUS FOR TIGHTENING THREADED FASTENERS

(71) Applicant: HYTORC Division UNEX Corporation, Mahwah, NJ (US)

(72) Inventors: Peter Koppenhoefer, Portland, PA (US); Thomas F. McLoughlin, Montclair, NJ (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 179 days.

(21) Appl. No.: 16/072,964

(22) PCT Filed: Jan. 26, 2017

(86) PCT No.: PCT/US2017/015148
§ 371 (c)(1),
(2) Date: Jul. 26, 2018

(87) PCT Pub. No.: WO2017/132387
PCT Pub. Date: Aug. 3, 2017

(65) Prior Publication Data

US 2019/0030691 A1 Jan. 31, 2019

Related U.S. Application Data

(60) Provisional application No. 62/293,170, filed on Feb. 9, 2016, provisional application No. 62/287,414, filed on Jan. 26, 2016.

(51) Int. Cl.
*B25B 21/00* (2006.01)

(52) U.S. Cl.
CPC ..... *B25B 21/005* (2013.01)

(58) Field of Classification Search
CPC ..... B25B 21/005; B25B 23/0007; B25B 23/0035; B25B 23/0078
See application file for complete search history.

(56) References Cited

U.S. PATENT DOCUMENTS 5,016,502 A * 5/1991 Junkers ..... B25B 21/005 81/57.39
6,912,933 B2 * 7/2005 Knopp ..... B23D 29/005 81/57.39

(Continued)

*Primary Examiner* — David B. Thomas
(74) *Attorney, Agent, or Firm* — Justin B. Bender, Esq.

(57) ABSTRACT

Torque tools of the present invention include: a hydraulic cylinder assembly (40); a drive assembly (600, 60); a flexible linkage connection, or force transfer, assembly formed between the hydraulic cylinder assembly (40) and the drive assembly (600, 60); all of which is formed within or adjacent to a housing assembly (70). They provide large, accurate torque for limited clearance applications. The flexible linkage connection assembly (50) includes a rocker arm assembly (51) and a chain link-pin assembly. The flexible linkage connection assembly (50) maintains the relationship between the line of action of the linear force generated on the rocker arm assembly (51) by the hydraulic piston assembly (44, 50)(ies) and rotary force generated on the ratchet drive socket (9) by the rocker arm assembly (51) via the chain link-pin assembly at close to the optimized position throughout the entire travel of a drive plate assembly (61) of the drive assembly (600, 60). The resulting efficiency increase of converting linear force and displacement into rotary torque and angular displacement allows for generation of large and accurate torque in minimal cross-sections necessary to access hidden, limited clearance and/or inaccessible threaded fasteners.

7 Claims, 4 Drawing Sheets

(56) References Cited

U.S. PATENT DOCUMENTS

| | | | | |
|---|---|---|---|---|
| 7,082,858 | B2 * | 8/2006 | Knopp | B23D 29/005 81/57.33 |
| 8,347,972 | B2 * | 1/2013 | Francis | B23P 19/061 166/380 |
| 8,640,780 | B2 * | 2/2014 | Francis | E21B 19/163 166/380 |
| 9,492,912 | B2 * | 11/2016 | Spirer | B25B 23/0007 |
| 9,890,599 | B2 * | 2/2018 | Francis | E21B 19/16 |
| 2018/0274310 | A1 * | 9/2018 | Francis | B25B 21/002 |

* cited by examiner

100

FL
28
29
31
41
32
33
34
42
30
3
14
80
11
15
40
43
4
100
46
35
18
8
23
5
44
7
45
53
17
21
19
20
13
10
62
60
50
51
52
16
9
63
1
54
6
61
22
12
70
26
27
90,92
91,93

APPARATUS FOR TIGHTENING THREADED FASTENERS

CROSS REFERENCE TO RELATED APPLICATIONS

This Application either claims priority to and/or is either a continuation patent application or a continuation-in-part application of the following commonly owned and patent applications, entire copies of which are incorporated herein by reference: U.S. application Ser. No. 62/287,414, having Filing Date of 26 Jan. 2016, entitled "APPARATUS FOR TIGHTENING THREADED FASTENERS"; and U.S. application Ser. No. 62/293,170, having Filing Date of 9 Feb. 2016, entitled "APPARATUS FOR TIGHTENING THREADED FASTENERS".

BACKGROUND

Numerous industrial bolting applications, such as, for example, gas turbines, include threaded fasteners that require tools which can apply large and accurate torque. Often, access to many of these fasteners requires limited clearance torque tools. Few options exist which are suitable to access such hidden fasteners. Those available options use a hydraulic cylinder coupled to a rigid linkage to convert linear force and displacement into rotary torque and angular displacement. Force transfer with such rigid linkages is optimized only at a single point where the line of action of the force is at a right angle to a line originating at the center of the rotating output member. For a given force the resulting torque generated decreases, eventually to zero, for linear displacement on either side of this single optimized point.

What are needed are improved force transfer linkages for torque tools.

SUMMARY

The invention addresses the needs of providing large, accurate and efficiently applied torque in limited access industrial bolting applications. A pair of links coupled via a flexible load transfer member maintains the relationship between the line of action of the force and rotating output member at close to the optimized position throughout the entire travel of the output of the tool. The resulting efficiency increase of converting linear force and displacement into rotary torque and angular displacement allows for generation of large and accurate torque in minimal cross-sections necessary to access hidden, limited clearance and/or inaccessible threaded fasteners. Specifically, the unique flexible load transfer member in the invention results in a narrow and compact tool, which is unique and unavailable.

BRIEF DESCRIPTION OF DRAWINGS

Four (4) pages of drawings are included.

FIG. 1A shows a perspective view of a lower side of a partially assembled torque tool 100.

FIG. 1B shows a perspective view of an upper side of partially assembled torque tool 100.

FIG. 1C shows a top view of the lower side of partially assembled torque tool 100.

FIG. 2A shows a top view of a back side of a fully assembled torque tool 100.

FIG. 2B shows a top view of the lower side of fully assembled torque tool 100.

FIG. 2C shows a top view of a front side of fully assembled torque tool 100.

FIG. 2D shows a top view of a left side of fully assembled torque tool 100.

FIG. 2E shows a perspective view of upper side of fully assembled torque tool 100.

FIG. 3 shows an exploded, perspective view of fully assembled torque tool 100.

DETAILED DESCRIPTION

Figure 1A:
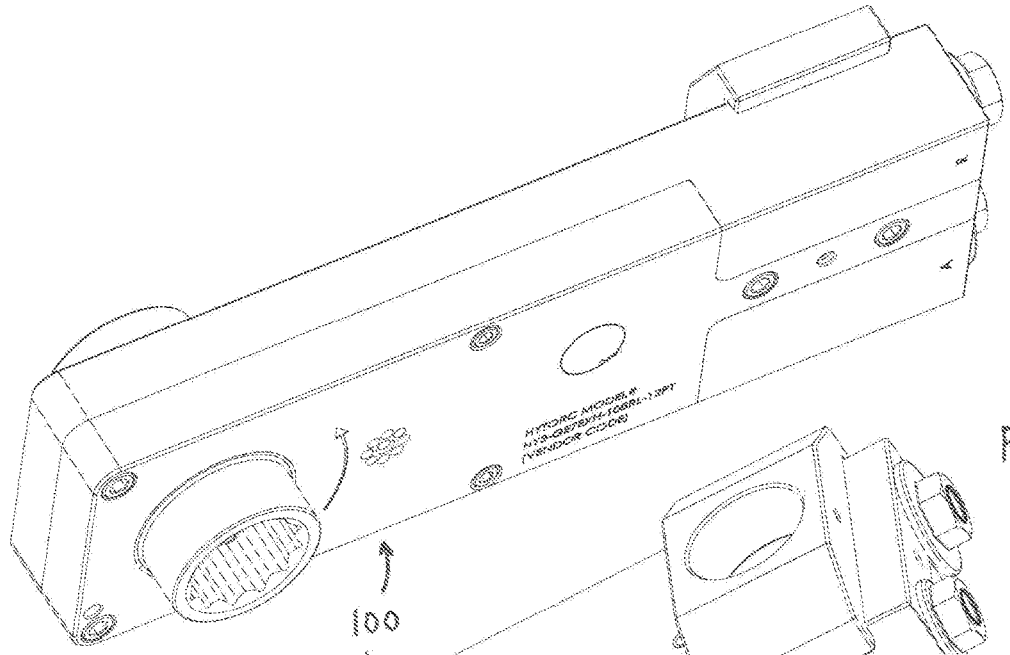
FIGS. 1A-1C, 2A-2E and 3 show various views of a torque tool 100.
Figure 1B:
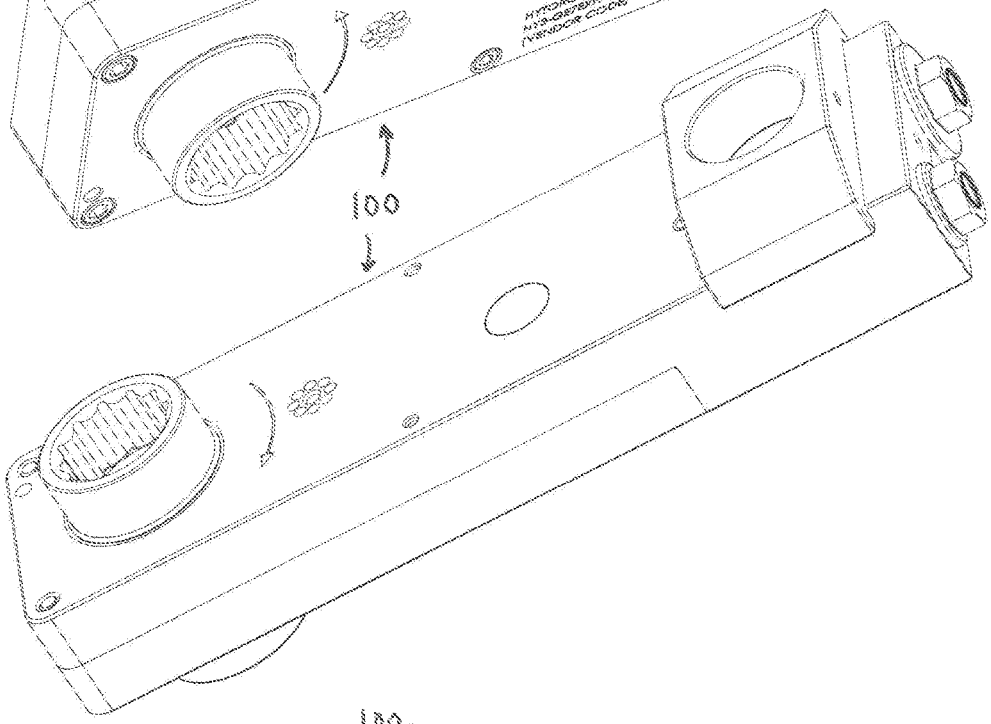
Figure 1C:
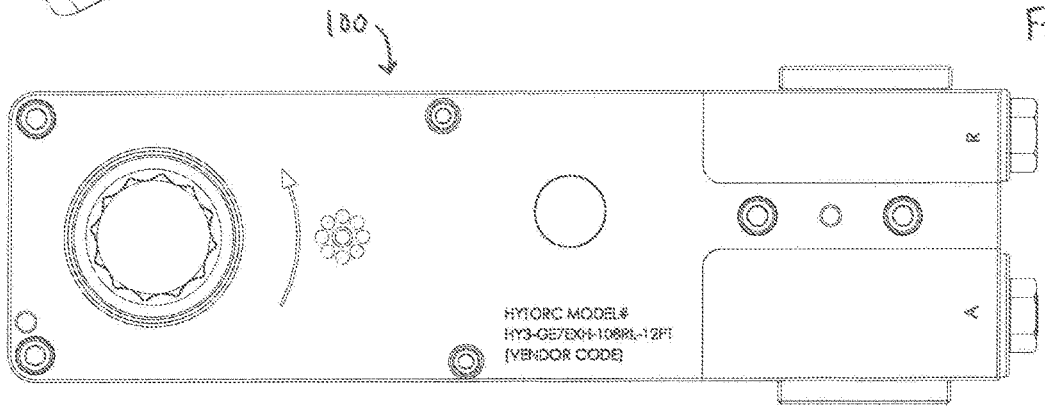
Figure 2A:
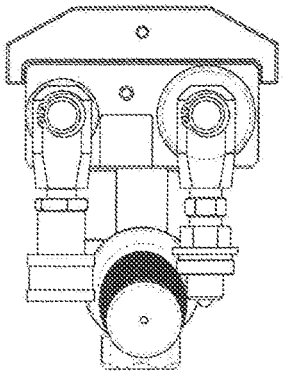
Figure 2D:
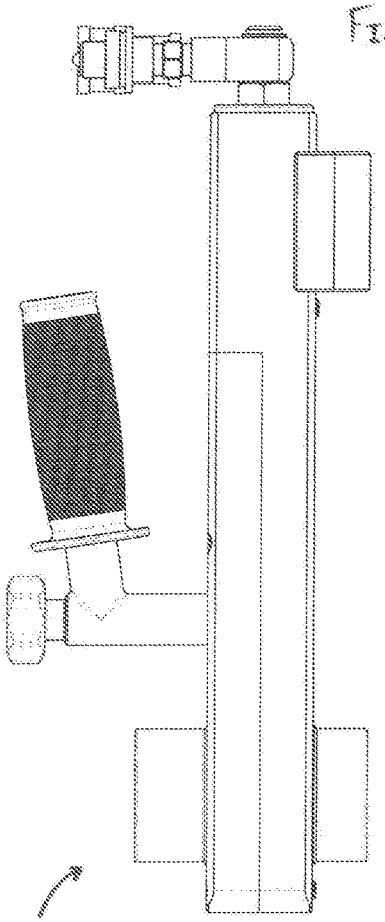
Figure 2B:
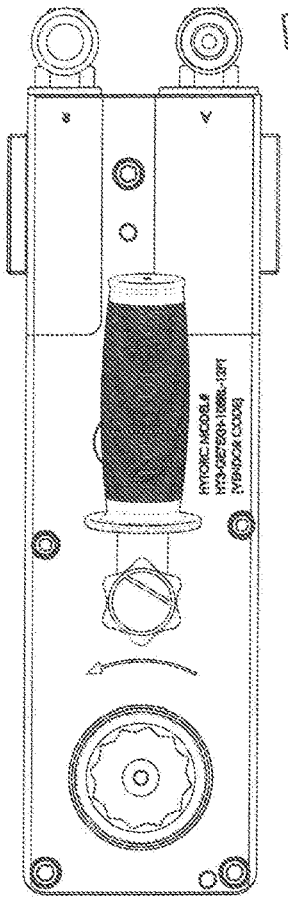
Figure 2E:
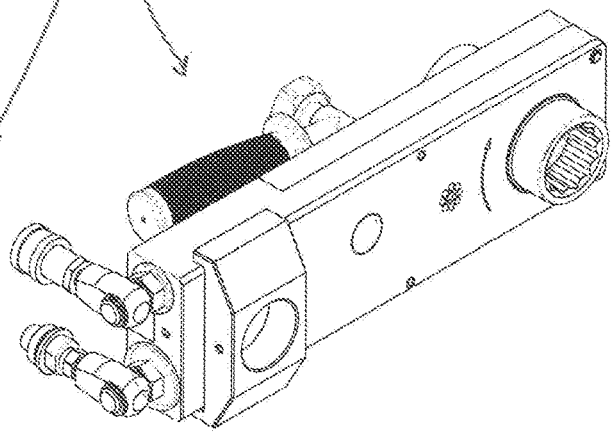
Figure 2C:
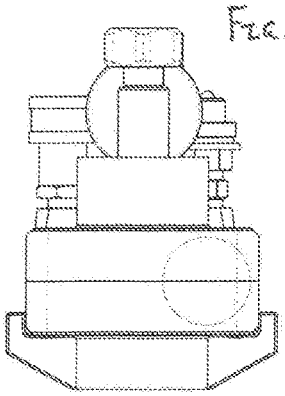
Figure 3:
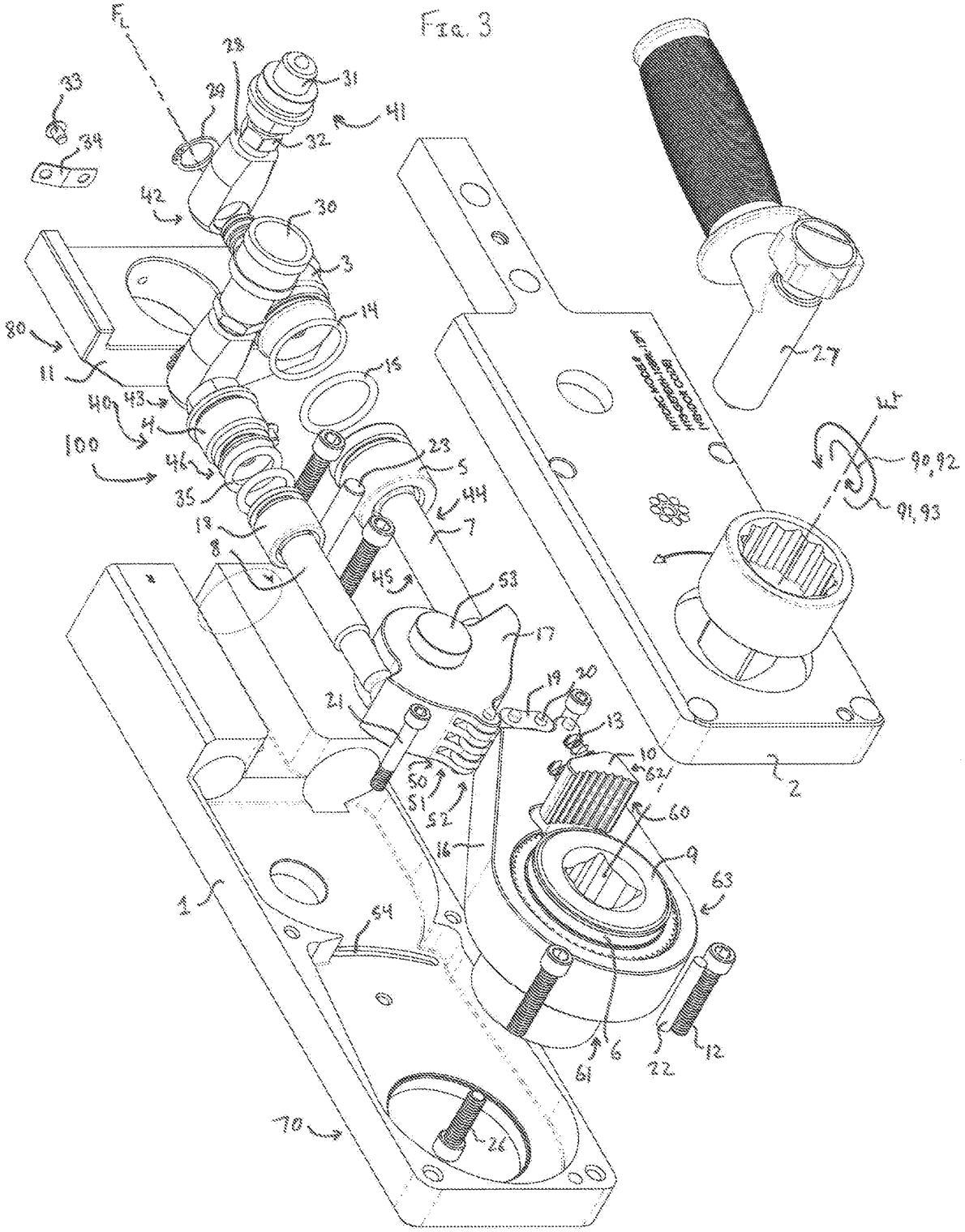

As shown in FIG. 3, by way of example, a torque tool 100, in this case for use with a GE7FA Gas Turbine, is hydraulically powered and used to tighten or loosen a threaded fastener, such as a bolt and/or a stud and nut combination (not shown), in a limited clearance location. Torque tool 100 includes: a hydraulic cylinder assembly 40; a drive assembly 60; a flexible linkage connection assembly 50 formed between hydraulic cylinder assembly 40 and drive assembly 60; all of which is formed within or adjacent to a housing assembly 70. Tool 100, as shown, also includes a reaction force assembly 80. Tool 100 converts linear motion of hydraulic cylinder assembly 40 to rotary motion acting on drive assembly 60 via flexible linkage connection assembly 50 to turn the threaded fastener.

Hydraulic cylinder assembly 40 operatively connects an external hydraulic drive unit (not shown) to piston assembly 50 and includes: a hydraulic connector (coupler) assembly 41; and a piston assembly 44. Hydraulic connector assembly 41 connects tool 100 to an external hydraulic supply (not shown), and includes first and second coupler assemblies 42 and 43. First coupler assembly 42 includes: a female swivel 28; an external retaining ring 29; a male hydraulic fluid coupler 31; and a nipple 32. Second coupler assembly 43 includes similar such component parts with the exception of a female hydraulic fluid coupler 30.

Piston assembly 44 operatively connects hydraulic connector assembly 41 to flexible linkage connection assembly 50, and includes first and second cylinder assemblies 45 and 46. First cylinder assembly 45 includes: a cylinder end cap 3; first and second o-rings 14 and 15; a piston 5; and a piston rod 7. Second cylinder assembly 46 includes: a cylinder end cap 4; first and second o-rings 35; a piston 18; and a piston rod 8.

Flexible linkage connection assembly 50 operatively connects piston assembly 44 to drive assembly 60 and includes: a rocker arm assembly 51; and a chain link-pin assembly 52. Rocker arm assembly 51 includes: rocker arm 17; and pivot connection 53. Rocker arm 17 pivotally attaches to first and second cylinder assemblies 45 and 46 toward a first end and chain link-pin assembly 52 toward a second end. Chain link-pin assembly 52 includes: chain link(s) 19; chain pin(s) 20; and pin groove(s) 54.

Drive assembly 60 operatively connects flexible linkage connection assembly 50 to the threaded fastener, such as a bolt and/or a stud and nut combination (not shown), and includes: a chain link drive plate assembly 61; a unidirectional ratchet mechanism assembly 62; and a drive socket assembly 63. Chain link drive plate assembly 61 includes a drive plate 16. Unidirectional ratchet mechanism assembly 62 includes: a drive segment, i.e. pawl, 10; and biasing spring(s) 13. Drive socket assembly 63 includes: a ratchet drive socket 9; side plate sleeve(s) 6; a tightening socket 25; and a socket-head cap screw (SHCS) 26. Ratchet drive socket 9 has an outer surface with ratchet teeth which rotatably couples with teeth of drive pawl 10 in one direction and non-rotatably couples with the teeth of drive pawl 10 in another direction. It has an inner surface which rotatably couples with an upper portion of tightening socket 25. And a lower portion of tightening socket 25 non-rotatably couples with the threaded fastener. Note that all rotatably coupled connection means described herein are known in the art, and include, for example, ratchet-teeth, spline, square, hexagonal, 12-point, etc.

Housing assembly 70 contains and/or is adjacent to hydraulic cylinder assembly 40, flexible linkage connection assembly 50 and drive assembly 600. It includes: a first housing portion 1; a second housing portion 2; connection means 61, including, for example, SHCS 12 and 21 and several dowel pins 22 and 23; a handle assembly 27; a reaction fixture 11; and a lanyard assembly 34. First housing portion includes a first piston housing A and a second piston housing R for first and second cylinder assemblies 45 and 46, respectively.

Generally, tool 100 converts the linear motion of hydraulic cylinder assemblies 45 and 46 acting on flexible linkage connection assembly 50 into a rotary motion acting on drive assembly 60 necessary to turn the threaded fastener.

As with all ratcheting-type tools, tool 100 generates torque in one direction only. The direction chosen, clockwise or counter-clockwise (i.e. tightening or loosening for a right hand thread) is controlled by which side of tool 100 is applied to the threaded fastener. Going forward, advance will be referred to as the torqueing direction and return being opposite of advance.

In the embodiment shown in FIG. 3, first coupler assembly 42 is the advance direction hydraulic connection and a second coupler assembly 43 is the return direction hydraulic connection. To advance tool 100 hydraulic pressure is applied to advance coupler assembly 42 while return coupler assembly 43 is connected to a low-pressure side of the hydraulic fluid supply. To return tool 100 hydraulic pressure is applied to return coupler assembly 43 while advance coupler assembly 42 is connected to the low-pressure side of the hydraulic fluid supply.

With respect to the advance direction, pressurized hydraulic fluid is introduced to and enters advance cylinder assembly 42 which is located substantially within first piston housing A. The pressurized hydraulic fluid applies an advance linear force, in proportion to the magnitude of the pressure, to piston 5. O-rings 14 and 15 seal advance cylinder assembly 42 to prevent leakage of hydraulic fluid. Piston 5 and piston rod 7 transfer the linear force which pushes on the advance side of rocker arm 17 causing it to rotate in a clockwise direction.

The clockwise rotation causes the return side of rocker arm 17 to push on piston rod 8 and piston 18. This creates a return linear force which pushes the hydraulic fluid in return cylinder assembly 43 through second coupler assembly 43 to the low pressure side of the external hydraulic drive unit.

Recall that rocker arm 17 is connected to drive plate assembly 61 via chain link(s) 19 and chain pin(s) 20 of chain link assembly 52. Clockwise rotation of rocker arm 17 results in counter-clockwise rotation of drive plate assembly 61 by the action of the components of chain link assembly 52. Pins 20 are guided into grooves 54 located within proximal locations of housing assembly 70.

Counter-clockwise rotation of drive plate 16 non-rotatably pushes against drive pawl 10. Ratchet drive socket 9 has an outer surface with ratchet teeth which rotatably couples with teeth of drive pawl 10 in one direction, a turning force direction, 93 and non-rotatably couples with the teeth of drive pawl 10 in another direction 91. Contact between drive pawl 10 and ratchet drive socket 9 is maintained by biasing springs 13. The geometry of a slot in drive plate 14 allows drive pawl 10 to push against ratchet drive socket 9 in one direction 93, thereby rotating tightening socket 25 and thus threaded fastener.

Generally, ratchet drive socket 9 has tightening socket 25, an integral 12-point hexagonal socket, on the side of tool 100 that faces threaded fastener when providing torque in the loosen direction. Ratchet drive socket 9 has an integral female square drive on the side of tool 100 that faces the threaded fastener when providing torque in the tighten direction. The square drive mates with the male square drive on tightening socket 25. Counter-clockwise rotation of ratchet drive socket 9 results in counter-clockwise rotation of tightening socket 25. Tightening socket 25 attaches to ratchet drive socket 9 via a SHCS 26.

A tightening cycle of tool 100 ceases when either advance piston 5 reaches the limits of travel within advance cylinder assembly 42 or when the torque generated by tool 100 is in equilibrium with the resisting torque of the threaded fastener.

Reaction fixture 11 transfers reaction force 91 acting about turning force axis $F_T$ in another direction 93 to a suitable reaction point.

With respect to the return direction, pressurized hydraulic fluid is introduced to and enters return cylinder assembly 43 which is located substantially within second piston housing R. The pressurized hydraulic fluid applies a return linear force, in proportion to the magnitude of the pressure, to piston 18. O-rings 35 seal return cylinder assembly 43 to prevent leakage of hydraulic fluid. Piston 18 and piston rod 8 transfer the linear force which pushes on the return side of rocker arm 17 causing it to rotate in a counter-clockwise direction.

The counter-clockwise rotation causes the advance side of rocker arm 17 to push on piston rod 7 and piston 5. This creates an advance linear force which pushes the hydraulic fluid in advance cylinder assembly 42 through first coupler assembly 42 to the low pressure side of the external hydraulic drive unit.

Recall that rocker arm 17 is connected to drive plate assembly 61 via chain link(s) 19 and chain pin(s) 20 of chain link assembly 52. Counter-clockwise rotation of rocker arm 17 results in clockwise rotation of drive plate assembly 61 by the action of the components of chain link assembly 52. Pins 20 are guided into grooves located within proximal locations of housing assembly 70.

Clockwise rotation of drive plate 16 non-rotatably pushes against drive pawl 10. Recall that ratchet drive socket 9 has an outer surface with ratchet teeth which rotatably couples with teeth of drive pawl 10 in turning force direction 93 and non-rotatably couples with the teeth of drive pawl 10 in another direction 91. Drive pawl 10 pushes against biasing springs 13 and displaces in a radial direction within the slot in drive plate 14 by sliding over the teeth of ratchet drive socket 9. This allows ratchet drive socket 9 to hold in position on the threaded fastener while drive plate 14 rotates in the clockwise direction.

A return cycle of tool 100 ceases when return piston 18A reaches the limits of travel within return cylinder assembly 43.

Figure 4:
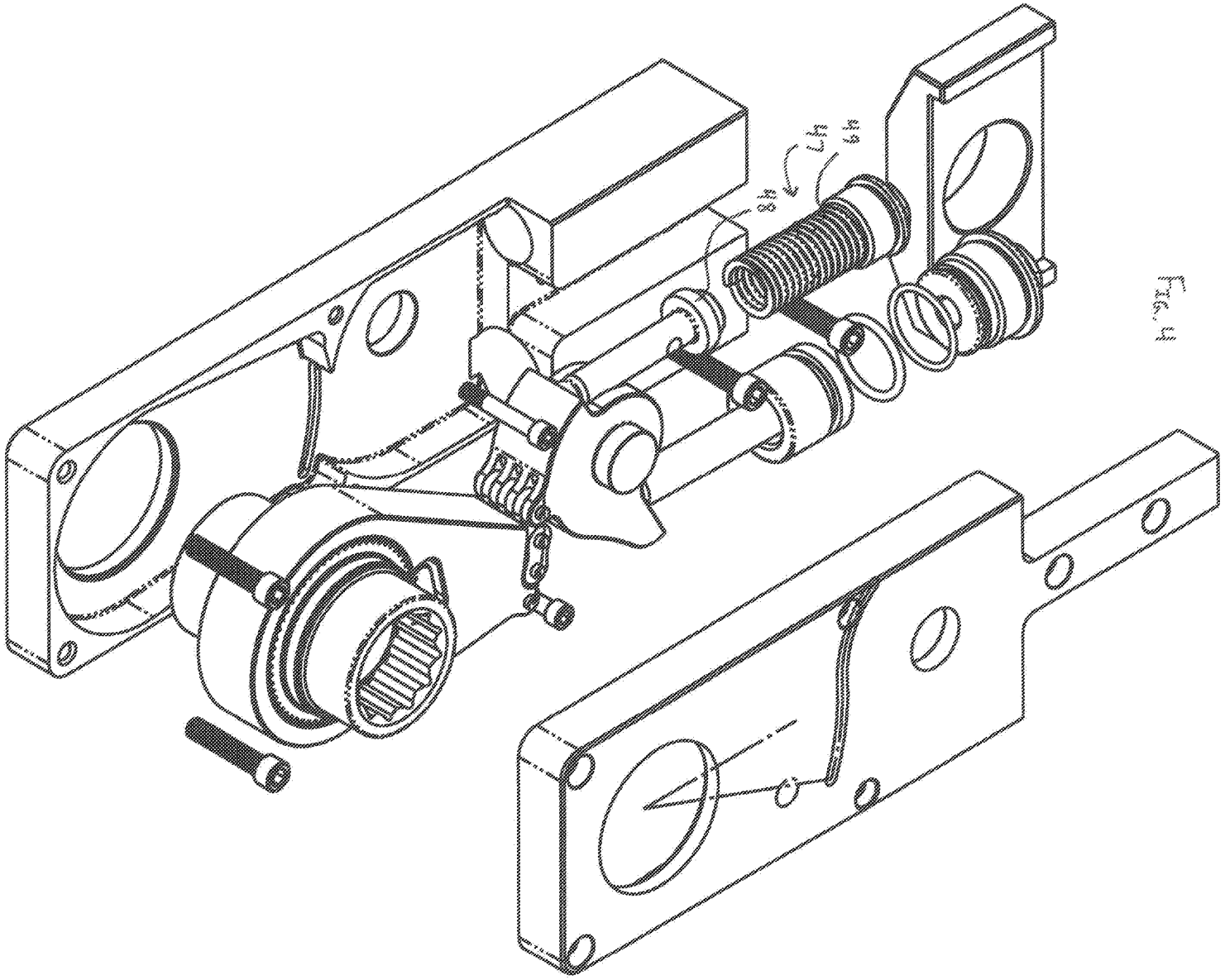
FIG. 4 shows an exploded, perspective view of a fully assembled torque tool 200, a second embodiment of the present invention.

Referring to FIG. 4, by way of example, this shows an exploded, perspective view of fully assembled torque tool 200, a second embodiment of the present invention. Torque tool 200 includes many of the same component parts as torque tool 100. Recall that torque tool 100 includes second coupler assembly 43 and second cylinder assembly 46. These components are not present in torque tool 200 and have been replaced by return spring assembly 47 including: a return spring piston 48; and a return spring 49. Return spring assembly 47 transfers a compression force acted upon return spring 49 during the advance stroke, in proportion to the magnitude of the pressure, to return spring piston 48. All other torque tool 100 discussion applies to torque tool 200.

Recall that torque tools of the prior art use a hydraulic cylinder coupled to a rigid linkage to convert linear force and displacement into rotary torque and angular displacement. Force transfer with such rigid linkages is optimized only at a single point where the line of action of the force is at a right angle to a line originating at the center of the rotating output member. For a given force the resulting torque generated decreases, eventually to zero, for linear displacement on either side of this single optimized point.

Torque tools of the present invention include: a hydraulic cylinder assembly; a drive assembly; a flexible linkage connection, or force transfer, assembly formed between the hydraulic cylinder assembly and the drive assembly; all of which is formed within or adjacent to a housing assembly. They provide large, accurate torque for limited clearance applications. The flexible linkage connection assembly includes a rocker arm assembly and a chain link-pin assembly. The flexible linkage connection assembly maintains the relationship between the line of action of the linear force generated on the rocker arm assembly by the hydraulic piston assembly(ies) and rotary force generated on the ratchet drive socket by the rocker arm assembly via the chain link-pin assembly at close to the optimized position throughout the entire travel of a drive plate assembly of the drive assembly. The resulting efficiency increase of converting linear force and displacement into rotary torque and angular displacement allows for generation of large and accurate torque in minimal cross-sections necessary to access hidden, limited clearance and/or inaccessible threaded fasteners.

It will be understood that each of the elements described above, or two or more together, may also find a useful application in other types of constructions differing from the types described above. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof. Note that there may be slight differences in descriptions of numbered components in the specification.

While the invention has been illustrated and described as embodied in a fluid operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

When used in this specification and claims, the terms "comprising", "including", "having" and variations thereof mean that the specified features, steps or integers are included. The terms are not to be interpreted to exclude the presence of other features, steps or components.

What is claimed is:

1. A torque tool to tighten and/or loosen a threaded fastener including:

a hydraulic cylinder assembly;

a drive assembly;

a flexible linkage connection assembly, formed between and operatively connected to the hydraulic cylinder assembly and the drive assembly, having:

a rocker arm assembly with a rocker arm and a pivot connection;

a chain-link pin assembly with chain link(s), chain pin(s) and pin groove(s); and wherein the flexible linkage connection assembly maintains a substantially optimized relationship between a line of action of a linear force generated on the rocker arm assembly by the hydraulic cylinder assembly and rotary force generated on the drive assembly by the rocker arm assembly throughout the entire travel of the drive assembly.

2. A torque tool according to claim 1 including:

a hydraulic connector assembly having a first and a second coupler assembly each including a female swivel, an external retaining ring, a male and/or female hydraulic fluid coupler and/or a nipple;

a piston assembly having a first and a second cylinder assembly each including a cylinder end cap, an o-ring, a piston, and/or a piston rod;

and the flexible linkage connection assembly;

the drive assembly having:

a chain link drive plate assembly having a drive plate; a unidirectional ratchet mechanism assembly having a drive segment and/or a biasing spring; and a drive socket assembly having a ratchet drive socket, a side plate sleeve, a tightening socket and/or a socket-head cap screw.

3. A torque tool according to claim 2 including a return spring assembly to transfer a compression force generated by an advance stroke of the piston assembly to reset the tool.

4. A torque tool according to claim 3 wherein the return spring assembly includes a return spring piston and a return spring.

5. A system for fastening objects including:

a threaded fastener; and a torque tool according to claim 1 or 2.

6. A torque tool according to claim 1 or 2 including a housing assembly having a first and a second housing portion, connection means, a handle assembly, a reaction fixture and/or a lanyard assembly.

7. A torque tool according to claim 6 wherein the first housing portion includes a first piston housing and a second piston housing for the first and the second cylinder assemblies.

* * * * *